US005195546A

United States Patent [19]

Cansler et al.

[11] Patent Number: 5,195,546

[45] Date of Patent: Mar. 23, 1993

[54] COSMETIC BRUSH AND BRISTLES

[75] Inventors: Ronald B. Cansler, Davidsonville; Scott B. Taylor, Glen Burnie; William M. Wagner, Severn, all of Md.

[73] Assignee: Ketema, Odenton, Md.

[21] Appl. No.: 625,390

[22] Filed: Dec. 11, 1990

[51] Int. Cl.[5] ..... A45D 40/24

[52] U.S. Cl. ..... 132/317; 132/313; 15/160; 15/167.3

[58] Field of Search ..... 132/216, 218, 290, 313, 132/317, 320; 15/160, 167.3, 159 A, 159 R

[56] References Cited

U.S. PATENT DOCUMENTS

| | | | |
|---|---|---|---|
| 1,197,210 | 9/1916 | Jordan | 132/320 |
| 2,511,004 | 6/1950 | Peterson | 15/159 A |
| 3,567,569 | 3/1971 | Ono et al. | 15/159 A |
| 4,605,022 | 8/1986 | Gueret | 132/313 |
| 4,726,387 | 2/1988 | Sarica | 132/313 |
| 4,733,425 | 3/1988 | Hartel et al. | 132/218 |

FOREIGN PATENT DOCUMENTS

| | | | |
|---|---|---|---|
| 41409 | 2/1986 | Japan | 132/320 |
| 1119203 | 5/1989 | Japan | 132/320 |
| 2155774 | 10/1985 | United Kingdom | 132/320 |

*Primary Examiner*—Gene Mancene
*Assistant Examiner*—Frank A. LaViola
*Attorney, Agent, or Firm*—Browdy and Neimark

[57] ABSTRACT

An improved cosmetic brush for the application of powder is made using synthetic bristles of nylon or polyester having a median diameter of about 3 mils and having a gentle random and irregular wavy configuration along the lengths of the bristles. The random and irregular wavy configuration provides the advantages of improving the fullness of the brush and at the same time improving both pick-up and lay-off of powder.

13 Claims, 3 Drawing Sheets

COSMETIC BRUSH AND BRISTLES

FIELD OF INVENTION

The present invention relates to cosmetic brushes and the bristles from which such cosmetic brushes are made, and more especially it concerns cosmetic brushes of the type used to apply make-up powder.

BACKGROUND OF THE INVENTION

Cosmetic brushes of the type noted above typically used for the application of make-up powder to the face have been conventionally made of goat's hair. However, there are a number of problems with the use of goat's hair including an irregular supply and inconsistencies from one batch to another. More importantly, however, such goat's hair must be irradiated or purified in some other manner for antiseptic purposes. More recently, goat's hair has been found to contain an unacceptably high rate of lice eggs, obviously very undesirable from a commercial and hygenic standpoint. In addition, many people are allergic to goat's hair.

It has, of course, been suggested to substitute synthetic bristles for goat's hair. However, while synthetic bristles for many other purposes have achieved substantial success, synthetic bristles for applying powder have not been successful, and these are used only in small amounts and then only in the cheapest cosmetic brushes. Such an inexpensive prior art cosmetic brush having a handle 12 and bristles 14' is shown in FIG. 1. The synthetic bristles heretofore used for this purpose have not had the desired fullness, nor have their qualities relating to powder pick-up and powder lay-off been satisfactory.

It is also, again of course, well known to produce crimped synthetic textile filaments and yarns. In the crimping of textile filaments, a main objective is to provide the crimp in a regular and repeated fashion as depicted in FIGS. 2A and 2B, and indeed much effort is taken to insure that the crimping gears are sharp and regular and that the filament yarns are spread out so that the crimping is accomplished in a relatively sharp and regularly repeated manner.

Moreover, textile filaments are too limp and too fine for use as make-up powder brush bristles, as these textile filaments do not normally exceed 1.0 mil in diameter and they are usually much finer, whereas make-up powder brush bristles less than 2 mils in diameter would be too limp. It has also been known to crimp coarse bristles, e.g. for hair brushes, toilet bowl brushes and the like, these brushes having bristles which have diameters of 10 mils and up.

SUMMARY OF THE INVENTION

It is, accordingly, an object of the present invention to overcome deficiencies in the prior art, such as indicated above.

It is another object of the present invention to provide an improved cosmetic brush for the application of powder to the human body, such cosmetic brush embodying improved synthetic bristles which do not suffer from the deficiencies of the prior art.

It is a further object of the present invention to provide such a high-quality cosmetic brush which does not rely on natural goat hair bristles.

It is yet another object of the present invention to provide a cosmetic brush for application of powder to the human body, which brush has the appearance and effectiveness of the highest quality goat-hair brushes, but which instead utilizes synthetic bristles.

It is yet a further object of the present invention to provide improved synthetic bristles for use in such a cosmetic brush.

These and other objects are achieved in accordance with the present invention by the provision of synthetic polymer bristles having random and irregular waves along the length thereof. When these bristles are gathered to form the cosmetic brush, the resultant brush is fluffy and full, similar in appearance to the finest goat-hair brush, but without the necessity for irradiation or fear of contamination, and without the allergy problems created by goat's hair. The wavy configuration also improves the powder pick-up and lay-off of the picked up powder onto the skin.

Other objects and the nature and advantages of the present invention will become further apparent from the following detailed description of certain specific embodiments of the present invention, taken in conjunction with the drawing, wherein:

DETAILED DESCRIPTION OF EMBODIMENTS

Figure 1:
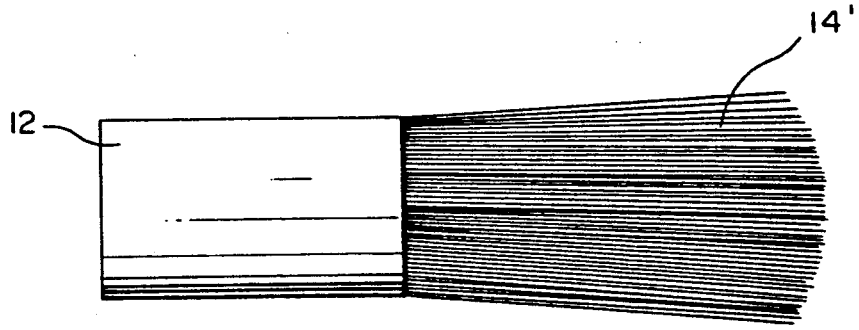
FIG. 1 PRIOR ART
FIG. 1 is plan view of a prior art cosmetic brush using synthetic bristles.
Figure 3:
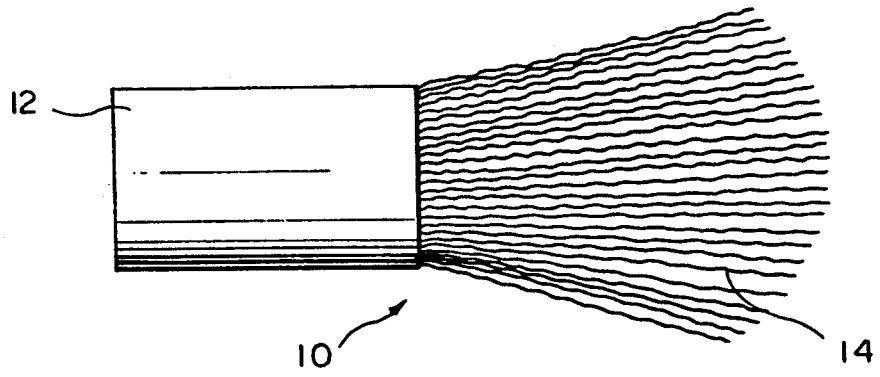
FIG. 3 is a plan view of a cosmetic brush in accordance with the present invention.

With reference to FIG. 3, there is shown a cosmetic brush 10 having a handle 12 and bristles 14 projecting therefrom about 1–3 inches, this brush 10 being for the application of make-up powder to the human body, especially the face. As can be best seen by comparing FIGS. 1 and 3, the brush 10 according to the present invention is much fuller than the prior art brush of FIG. 1.

Figure 4A:
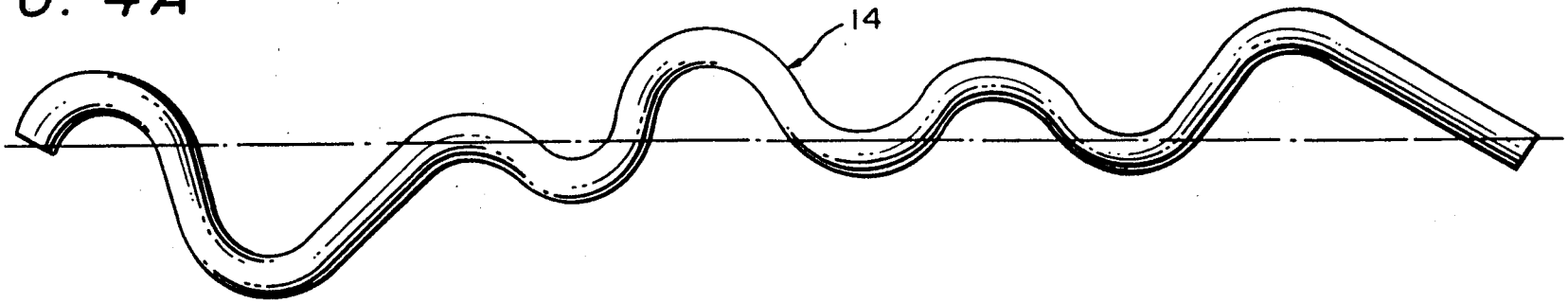
FIGS. 4A, 4B and 4C are respectively side views at 90° from each other and an end view, all greatly enlarged, of bristles in accordance with the present invention used in the brush of FIG. 1.
Figure 4C:
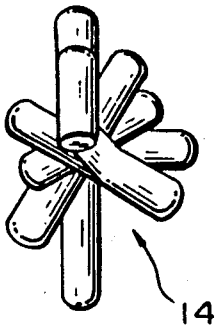
Figure 4B:
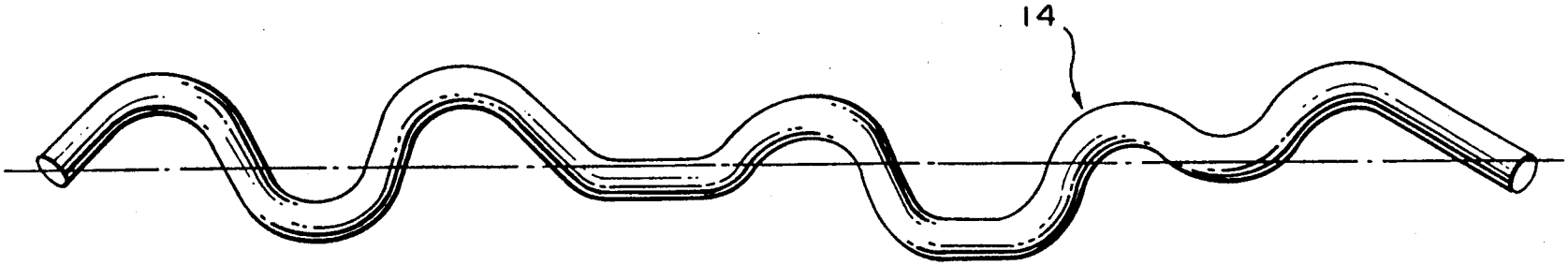

A key, novel feature of the present invention is the use of the especially prepared bristles 14 which have a gentle wavy configuration in a random and irregular fashion, as shown in FIGS. 4A, 4B and 4C. As can be seen from these figures, the gentle waves are irregular and random in both frequency and amplitude. When these wavy bristles 14 are collected and formed into the brush 10, the bristles 14 lay against one another in a non-complementary fashion and that results both in a fuller or fluffier brush as illustrated in FIG. 3, and in improved pick-up and lay-off of cosmetic powder.

The bristles 14 according to the present invention are extruded from synthetic polymer according to conventional practice, such synthetic polymer being selected from among those commonly used in the manufacture of brush bristles and including polyolefins, polyamides and polyesters, preferably various types of polyamides (nylons) and PET. Upon formation of the bristles, preferably having a circular cross-section and a diameter in the range of 2.0–4.5 mils, most preferably about 3 mils, the bristles are subjected to an appropriate treatment to provide the required wavy configuration in a random and irregular fashion.

Figure 2A:
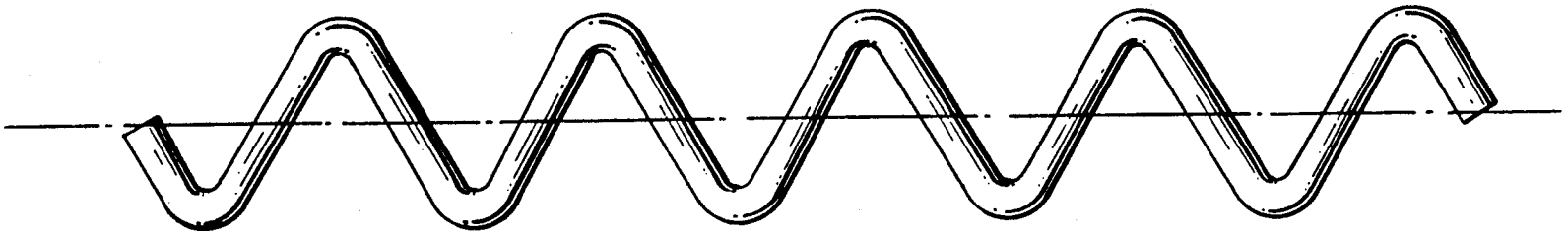
FIG. 2A PRIOR ART
FIGS. 2A and 2B are illustrations on a greatly enlarged scale of a conventional crimped synthetic textile monofilament made by conventional gear-wheel crimping, taken at 90° from one another.
Figure 2B:
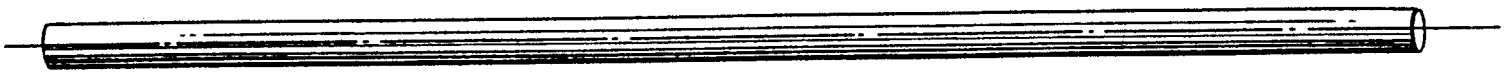
FIG. 2B PRIOR ART

In one example for imparting the wavy configuration of the bristles 14 as illustrated in FIG. 2, after extrusion, drawing, quenching and orientation in the usual way to obtain monofilament bristles having a diameter of 3 mils, the monofilament bristles were gathered and passed between a pair of gear wheels having rounded and irregular gear teeth, contrary to acceptable filament crimping gears. In addition to the difference in the wave imparting gear wheels compared to conventional crimping gear wheels used for the crimping of textile filaments, another difference was that the bristles were passed between the wave imparting gears in a clump as opposed to the spread-apart manner in which textile filaments are passed through crimping gears. Both nylon and polyester bristles are made in this fashion, producing a random and irregular wavy configuration as illustrated in FIGS. 4A, 4B and 4C, and in contrast to the very regular sharply crimped configuration imparted to textile filaments as shown in FIGS. 2A and 2B by the use of conventional crimping gears.

If desired, the bristles 14 can have a rough surface, such as a surface provided by a post-roughening process, e.g. by sanding.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a cosmetic brush for the application of powder to the human skin, comprising a handle and a plurality of bristles extending from said handle from one end thereof, the improvement wherein said plurality of bristles form a full and fluffy brush configuration, said bristles being of diameter of 2.0–4.5 mils and being formed of synthetic plastic, each of said bristles having a random and irregular wavy configuration in amplitude and frequency along its length extending from said handle, and adjacent bristles having non-complementary wave patterns.

2. A cosmetic brush according to claim 1 wherein said bristles have a median diameter of about 3 mils.

3. A cosmetic brush according to claim 1 wherein said synthetic plastic is selected from the group consisting of nylon and polyester.

4. A cosmetic brush according to claim 1 wherein said bristles extend from said handle a distance of about 1–4 inches.

5. A cosmetic brush according to claim 1 wherein said bristles have a rough surface.

6. A group of cosmetic brush bristles adapted for the manufacture of a cosmetic brush for the application of powder to the skin, each said bristle having a diameter of about 2–4.5 mils and being formed of a synthetic plastic and having a random and irregular wavy configuration in amplitude and frequency entire along its length.

7. Bristles according to claim 6 each having a median diameter of about 3 mils.

8. Bristles according to claim 6 wherein said synthetic plastic is selected from the group consisting of nylon and polyester.

9. Bristles according to claim 6 having a rough surface.

10. In a cosmetic brush for the application of powder to the human skin, comprising a handle and a plurality of synthetic plastic bristles extending from said handle from first ends of said bristles to second powder-applying free ends thereof, the improvement comprising means for improving powder pick-up on said synthetic bristles and lay-off of picked-up powder from said bristles onto the skin, said means comprising a substantial plurality of said bristles in a form having a random and irregular wavy configuration at said free ends thereof, adjacent bristles having a non-complimentary configuration, said synthetic plastic bristles having a diameter of about 2.0–4.5 mils.

11. A cosmetic brush according to claim 10 wherein said bristles have a median diameter of about 3 mils.

12. A cosmetic brush according to claim 10 wherein said synthetic plastic is selected from the group consisting of nylon and polyester.

13. A cosmetic brush according to claim 10 wherein said bristles extend from said handle a distance of about 1–4 inches.

* * * * *